US006770406B1

(12) United States Patent
Reynolds et al.

(10) Patent No.: US 6,770,406 B1
(45) Date of Patent: Aug. 3, 2004

(54) IMAGING ELEMENT CONTAINING A POLYMERIC BENZYLIC BLOCKED DEVELOPER

(75) Inventors: James H. Reynolds, Rochester, NY (US); Douglas R. Robello, Webster, NY (US); David H. Levy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/339,141

(22) Filed: Jan. 9, 2003

(51) Int. Cl.[7] ..... G03C 1/42; G03C 1/43; G03C 1/498

(52) U.S. Cl. ..... 430/21; 430/350; 430/404; 430/442; 430/443; 430/448; 430/480; 430/482; 430/484; 430/485; 430/566; 430/619; 430/959; 430/964

(58) Field of Search ..... 430/21, 480, 481, 430/482, 483, 484, 485, 619, 959, 350, 566, 404, 448, 443, 442, 618, 964, 264, 464

(56) References Cited

U.S. PATENT DOCUMENTS

| | | | | |
|---|---|---|---|---|
| 3,342,599 A | | 9/1967 | Reeves | |
| 4,060,418 A | | 11/1977 | Waxman et al. | |
| 4,157,915 A | | 6/1979 | Hamaoka et al. | |
| 5,800,974 A | * | 9/1998 | Wallis et al. | 430/566 |

OTHER PUBLICATIONS

Research Disclosure No. 12924, Jan. 1975, vol. 129, pp. 27–30, Kenneth Mason Publications, Ltd., Dudley Annex, 12a North Street, Emsworth, Hampshire P010 7DQ, England.

* cited by examiner

*Primary Examiner*—Thorl Chea
(74) *Attorney, Agent, or Firm*—Chris P. Konkol

(57) ABSTRACT

This invention relates to an imaging element comprising an imaging layer having associated therewith a compound of Structure I:

wherein PUG is a residue of removing a hydrogen from wherein X, Y, and Z represent substituents selected independently from the groups hydrogen, alkyl group of 1 to 6 carbon atoms, cyclopropyl, aryl, arylalkyl, and heterocyclic groups, wherein at least one of X, Y, and Z is an aryl group and one of X, Y, Z, which may or may not be an aryl group, is attached in the direction of the backbone, and the other substituents are as defined in the specification. Such compounds have good reactivity and can by used to block photographically useful compounds such as developing agents until thermally activated under preselected conditions. Compounds according to the present invention are especially useful in color photothermographic imaging elements.

23 Claims, 2 Drawing Sheets

IMAGING ELEMENT CONTAINING A POLYMERIC BENZYLIC BLOCKED DEVELOPER

FIELD OF THE INVENTION

This invention relates to an imaging element containing a blocked photographically useful compound such as a developing agent.

BACKGROUND OF THE INVENTION

In conventional color photography, films containing light-sensitive silver halide are employed in hand-held cameras. Upon exposure, the film carries a latent image that is only revealed after suitable processing. These elements have historically been processed by treating the camera-exposed film with at least a developing solution having a developing agent that acts to form an image in cooperation with components in the film. Developing agents commonly used are reducing agents, for example, p-aminophenols or p-phenylenediamines.

Typically, developing agents (also herein referred to as developers) present in developer solutions are brought into reactive association with exposed photographic film elements at the time of processing. Segregation of the developer and the film element has been necessary because the incorporation of developers directly into sensitized photographic elements can lead to desensitization of the silver halide emulsion and undesirable fog (indiscriminate image formation). Considerable effort, however, has been directed to producing effective blocked developing agents (also referred to herein as blocked developers) that might be introduced into silver halide emulsion elements without deleterious desensitization or fog effects. Accordingly, blocked developing agents have been sought that would unblock under preselected conditions of development after which such developing agents would be free to participate in image-forming (dye or silver metal forming) reactions.

U.S. Pat. No. 3,342,599 to Reeves discloses the use of Schiff-base developer precursors. Schleigh and Faul, in a *Research Disclosure* (129 (1975) pp. 27–30), describes the quaternary blocking of color developers and the acetamido blocking of p-phenylenediamines. (All Research Disclosures referenced herein are published by Kenneth Mason Publications, Ltd., Dudley Annex, 12a North Street, Emsworth, Hampshire P010 7DQ, ENGLAND.) Subsequently, U.S. Pat. No. 4,157,915 to Hamaoka et al. and U.S. Pat. No. 4,060,418 to Waxman and Mourning describe the preparation and use of blocked p-phenylenediamines in an image-receiving sheet for color diffusion transfer.

All of these approaches have failed in practical product applications because of one or more of the following problems: desensitization of sensitized silver halide; unacceptably slow unblocking kinetics; instability of blocked developer yielding increased fog and/or decreased Dmax after storage, lack of simple methods for releasing the blocked developer, inadequate or poor image formation, and other problems. Especially in the area of photothermographic color films, other potential problems include poor discrimination and poor dye-forming activity.

PROBLEM TO BE SOLVED

There remains a need for blocked photographically useful compounds with good keeping properties, which at the same time exhibit good unblocking kinetics. With respect to developing agents, it is an object to obtain a film incorporating blocked developing agents that provide good dye-forming activity and which, at the same time, yield little or no increased fog and/or provide little or no decrease in Dmax after storage.

It is a further object to obtain blocked photographically useful agents for use in photothermographic color films. In photothermographic systems all of the required imaging materials must be present simultaneously within the film package. That is, the package must contain silver halide, coupler, and developer, which, unfortunately, presents the problem of premature reaction and consequently increased Dmin or fog. In developing a color photothermographic film, fog is one of the most pressing problem, particularly during raw stock keeping.

With respect to developing agents, there is a continuing need for photothermographic imaging elements that contain a developing agent in a form that is stable until development yet can rapidly and easily develop the imaging element once processing has been initiated by heating the element and/or by applying a processing solution, such as a solution of a base or acid or pure water, to the element. A completely dry or apparently dry process is most desirable. The existence of such a process would allow for very rapidly processed films that can be processed simply and efficiently in photoprocessing kiosks. Such kiosks, with increased numbers and accessibility, could ultimately allow for, relatively speaking, anytime and anywhere silver-halide film development.

SUMMARY OF THE INVENTION

This invention relates to a "polymeric blocked developer" in which a releasable photographic developer is pendant from the polymeric backbone via a chain that comprises, in order from the releasable developer, a linking group, a blocking group comprising a benzylic moiety, and one or more optional connecting groups, which polymeric blocked developer is hereinafter referred to as a "polymeric benzylically blocked developer". This material decomposes (i.e., unblocks) on thermal activation to release a photographically useful developing agent (also referred to herein as DEV).

In one embodiment, thermal activation preferably occurs at temperatures between about 100 and 180° C. In another embodiment, thermal activation preferably occurs at temperatures between about 20 and 140° C. in the presence of added acid, base and/or water.

The invention further relates to a light sensitive photographic element comprising a support and a polymeric benzylically-blocked developing agent that decomposes on thermal activation to release a photographically useful group.

The invention additionally relates to a method of image formation having the steps of: thermally developing an imagewise exposed photographic element having a polymeric benzylically-blocked developing agent that decomposes on thermal activation to form a developed image, scanning said developed image to form a first electronic image representation (or "electronic record") from said developed image, digitizing said first electronic record to form a digital image, modifying said digital image to form a second electronic image representation, and storing, transmitting, printing or displaying said second electronic image representation.

The invention further relates to a one-time use camera having a light sensitive photographic element comprising a support and a polymeric benzylically-blocked developing agent that decomposes on thermal activation. The invention further relates to a method of image formation having the steps of imagewise exposing such a light sensitive photographic element in a one-time-use camera having a heater and thermally processing the exposed element in the camera.

In accordance with the present invention, a polymeric blocked developer comprising repeat units having the general structure shown in Structure (I):

(I)

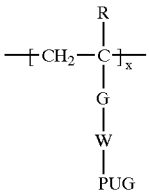

wherein R, G, W, and x are as defined below and PUG is a residue of removing a hydrogen from one of X, Y, or Z in the following compound:

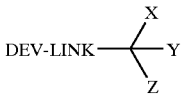

wherein X, Y, and Z represent substituents selected independently from the groups hydrogen, alkyl group of 1 to 6 carbon atoms, cyclopropyl, aryl, arylalkyl, and heterocyclic groups, wherein at least one of X, Y, and Z is an aryl group and one of X, Y, Z, which may or may not be an aryl group, is attached in the direction of the backbone.

DETAILED DESCRIPTION OF THE INVENTION

Figure 1:
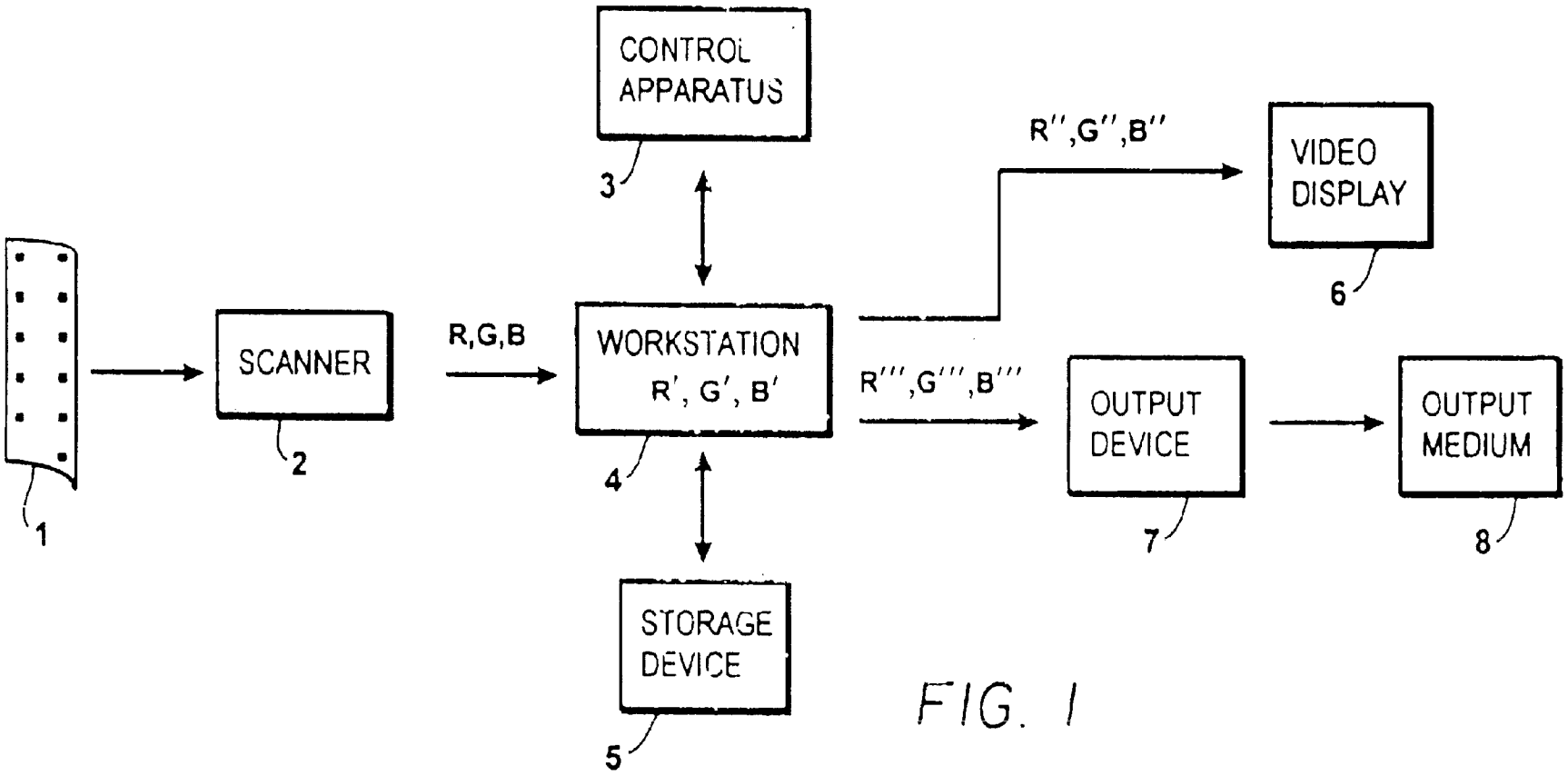
FIG. 1 shows in block diagram form an apparatus for processing and viewing image formation obtained by scanning the elements of the invention.

In accordance with the present invention, a polymeric blocked developer comprising the general structure shown in Structure I.

(I)

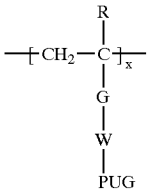

wherein x (subscript) indicates the number of the repeat units in the Structure I (that is, the average degree of polymerization of the repeat unit above in the polymeric blocked developer), R is hydrogen or methyl and G is selected from the following group:

(C)

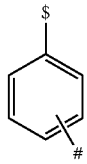

(D)

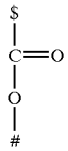

(E)

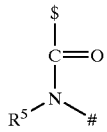

wherein $ denotes the bond to the polymeric backbone and # denotes the bond in the direction of the polymeric backbone, to W if present, in Structure I, and wherein $R^5$ is hydrogen or substituted or unsubstituted alkyl or aryl;

W is absent or a bivalent spacer group selected from a substituted or unsubstituted (referring to the following W groups) alkylene (preferably containing 1 to 6 carbon atoms), arylene (such as phenylene), alkylarylene or alkyleneoxy (for example, #-A—O—S wherein A is an alkylene group) and wherein W in combination with X, Y, or Z below may form a ring.

In one embodiment, W is an activating group when an alkylene or alkyleneoxy group is substituted with one or more electron donating groups; an arylene or alkylarylene group substituted with one to seven electron donating groups. More preferably, when W is substituted with an electron donating group, the substituent is a group such as hydroxy, alkoxy, aryloxy, amino, alkylamino, dialkyl amino, arylamino, diarylamino, phenyl or other aryl or heteroaryl, alkyl, etc.

As indicated above, W may be joined to form a ring with any of the X, Y, or Z groups defined below, provided that creation of the ring will not interfere with the functioning of the blocking group.

and wherein PUG is a residue of removing a hydrogen from one of X, Y, or Z in the following group:

(II)

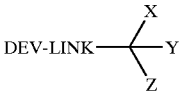

DEV is a releasable developing agent; and

LINK is a linking group.

wherein X, Y, and Z represent substituents selected independently from the groups hydrogen, alkyl group of 1 to 6 carbon atoms, cyclopropyl, aryl, arylalkyl, and heterocyclic groups, wherein at least one of X, Y, and Z is an aryl group and one of X, Y, Z, which may or may not be an aryl group, is attached in the direction of the backbone. The cyclopropyl group may be further substituted with an alkyl group of 1 to 6 carbon atoms. The aryl and heterocyclic groups may be in turn substituted with the following substituents: halogen, alkyl of 1 to 6 carbon atoms, aryl, arylalkyl, alkoxy, aryloxy, arylalkyloxy, alkylthio, arylthio, arylalkylthio, N,N-dialkylamino, N,N-diarylamino, N,N-diarylalkylamino, N-alkyl-N-arylamino, N-alkyl-N-arylalkylamino, and N-aryl-N-arylalkylamino.

In a preferred embodiment, one or more of the X, Y or Z groups have an oxygen attached thereto. Additionally, two members of the X, Y, and Z set can join to form a ring. Typically, the aryl group is represented by phenyl, 1-naphthyl, 2-naphthyl, and 9-anthracyl groups while the heterocyclic group is best represented by 2-furyl, 3-furyl, 2-thienyl, 3-thienyl, 2-pyrrolyl, 3-pyrrolyl, 2-thiazolyl, 2-benzothienyl, 3-benzothienyl, 2-indolyl, and 3-indolyl.

As indicated below, preferable the benzylic group should have an electron donating group. When referring to electron donating groups, this can be indicated or estimated by the Hammett substituent constants ($\sigma_p$, $\sigma_m$), as described by L. P. Hammett in Physical Organic Chemistry (McGraw-Hill Book Co., NY, 1940), or by the Taft polar substituent constants ($\sigma_I$) as defined by R. W. Taft in Steric Effects in Organic Chemistry (Wiley and Sons, NY, 1956), and in other standard organic textbooks. The $\sigma_p$ and $\sigma_m$ parameters, which were used first to characterize the ability of benzene ring-substituents (in the para or meta position) to affect the electronic nature of a reaction site, were originally quantified by their effect on the pKa of benzoic acid. Subsequent work has extended and refined the original concept and data, and for the purposes of prediction and correlation, standard sets of $\sigma_p$ and $\sigma_m$ are widely available in the chemical literature, as for example in C. Hansch et al., J. Med. Chem., 17, 1207 (1973). For substituents attached to a tetrahedral carbon instead of aryl groups, the inductive substituent constant $\sigma_I$ is herein used to characterize the electronic property. Preferably, an electron donating group on an aryl ring has a $\sigma_p$ or $\sigma_m$ of less than zero, more preferably less than 0.05, most preferably less than 0.1. The $\sigma_p$ is used to define electron donating groups on aryl groups when the substituent is neither para nor meta. Similarly, an electron donating group on a tetrahedral carbon preferably has a $\sigma_I$ of less than zero, more preferably less than 0.05, and most preferably less than 0.1. When more than one electron donating group is present, then the summation of the substituent constants is used to estimate or characterize the total effect of the substituents.

As indicated above, the polymeric blocked developers of the present invention are useful in photothermography. Such polymeric blocked developers are designed to release a developer when heated during processing, but protect the developer from chemical reactions (coupling, oxidation, etc.) at ordinary temperatures. The release chemistry involves elimination from a benzylic carbamate side group.

These polymeric blocked developers were found to possess good reactivity and image discrimination during use. The use of the polymeric protecting groups offer unique advantages for photothermography, including the production of relatively immobile, preferably nonvolatile, by-products, favorable release kinetics, and facile production of aqueous dispersions.

The polymeric benzylically blocked developers can provide a unique combination of properties when used in photothermographic film. The polymeric blocked developer, which will exist as beads in the film package, has very high MW and will not be prone to wander among layers. After thermal development, the residue of the blocking group is also polymeric, and will not diffuse out of its layer.

Another advantage is that the $T_g$ of the polymer can be used to provide a discontinuity in the release rate vs. temperature profile of the blocked developer (i.e., non-Arrhenius behavior). In particular, if the polymers are prepared with a $T_g$ of approximately 100° C., the release reaction could be shut down near room temperature (good for raw stock keeping), but still proceed at the anticipated thermal development temperatures, at which the polymer is a liquid.

Preferably, polymeric benzylically blocked developers are obtained by polymerization of an appropriately functionalized monomer containing the blocked developer moiety. An alternative technique is to attach the blocked developer moiety to a preformed polymer, but this approach is less preferred because of the difficulties obtaining high conversions in polymer analogous reactions, and in analyzing the product obtained.

Polymerization of suitably substituted monomers leads to predictable polymers. In particular, vinyl polymerization is preferred. For example, styrene derivatives of blocked developers can be synthesized in only a few steps from available starting materials, and the vinyl polymerization of styrene derivatives tolerates the attached benzylic carbamate. However, other monomers can be prepared, for example, acrylic versions.

Various types of polymeric backbones can be employed. For example, polymeric backbones based on step polymerization chemistry such as polyesters, polyamides, polyurethanes, polyethers, and the like can be employed, but are not preferred because of the synthetic complexity and the high temperatures that are often employed during synthesis. Preferred polymeric backbones are derived from ethylenically unsaturated monomers such as styrenes, vinyl esters, fumarates, acrylates and methacrylates, acrylamides and methacrylamides, etc. Polymeric backbones based on styrene are most preferred because of the facility for monomer synthesis and polymerization at suitably low temperatures. In all cases, the heteroaromatic linkages and blocked developer moieties are attached to the polymeric backbones as side chains, for ease of release upon heating or similar simple processing.

Moderately high molar mass polymers are preferred, wherein the average degree of polymerization has a value of at least 10, preferably about 100. In this way, the average molar mass of the polymer is in the range of 10,000 to 1,000,000. In the case of a polymer in which all the repeat units are as represented in Structure I, the degree of polymerization of the polymer corresponds to the subscript x in Structure I above.

In addition, the polymer backbone can also contain optional repeat units derived from comonomers such substituted or unsubstituted styrenes, acrylic esters, methacrylic esters, acrylonitrile, substituted or unsubstituted acrylamides, substituted or unsubstituted maleimides, maleic anhydride, acrylic acid, methacrylic acid, and the like in order to modify physical properties such as solubility, dispersability, glass transition temperature, etc. Such comonomers are preferably employed as less than 50% of the repeat units in order to avoid undesirable dilution of the blocked developer moieties.

Polymeric blocked developers containing benzylic carbamate linkages or the like can be synthesized in a straightforward manner, as illustrated in the Examples below.

After synthesis, the polymeric blocked developers are soluble, have moderately high molecular weights, and exhibit glass transition temperatures, which may be advantageous for kinetics. Preferably the Tg should be not too high so the material is fluid during thermal development and not too low so that the material is a conveniently isolatable solid at room temperature. Photothermographic tests indicate that the presence of the polymer backbone may reduce the reactivity of the release linkage compared to low MW analogs. Nevertheless, films containing these polymeric blocked developers can be made that have the desired reactivity and in some cases, a reduction in reactivity for a highly reactive blocked developer compound may even be desirable.

In a preferred embodiment of the invention, LINK is of structure III:

III

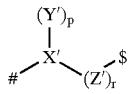

wherein

X' represents carbon or sulfur;

Y' represents oxygen, sulfur or N—R, where R is substituted or unsubstituted alkyl or substituted or unsubstituted aryl;

p is 1 or 2;

Z' represents carbon, oxygen or sulfur;

r is 0 or 1;

with the proviso that when X' is carbon, both p and r are 1, when X' is sulfur, Y' is oxygen, p is 2 and r is 0;

# denotes the bond in the direction of the releasable developing agent;

$ denotes the bond, in the direction of the polymeric backbone, to the carbon atom (a tetrahedral carbon) substituted with the X, Y, and Z substituents in Structure II.

Illustrative linking groups include, for example,

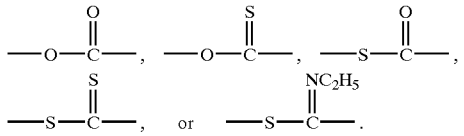

In a preferred embodiment, the DEV of Structure II is the residue formed by removing a hydrogen from a blocked developer having the following Structure IIA:

IIA

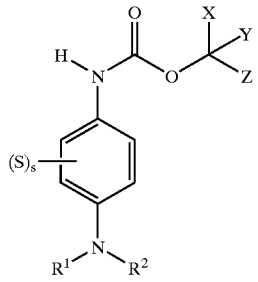

wherein $R^1$ and $R^2$ are independently hydrogen or an alkyl group, which may be further substituted, or $R^1$ and $R^2$ may join to form a heterocyclic ring;

S represents s independently selected substituents selected from the group consisting of halogen, hydroxy, amino, alkoxy, carbonamido, sulfonamido, alkylsulfonamido or alkyl, any of which may be further-substituted or S substituents that are ortho to the $NR^1R^2$ substituent can form a heterocyclic ring with $R^1$ or $R^2$; and s is 0 to 4;

When reference in this application is made to a particular moiety or group, "substituted or unsubstituted" means that the moiety may be unsubstituted or substituted with one or more substituents (up to the maximum possible number), for example, substituted or unsubstituted alkyl, substituted or unsubstituted benzene (with up to five substituents), substituted or unsubstituted heteroaromatic (with up to five substituents), and substituted or unsubstituted heterocyclic (with up to five substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy, substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched, unbranched, or cyclic.

The following are representative examples of photographically useful compounds of Structure II for use in the invention:

D-1

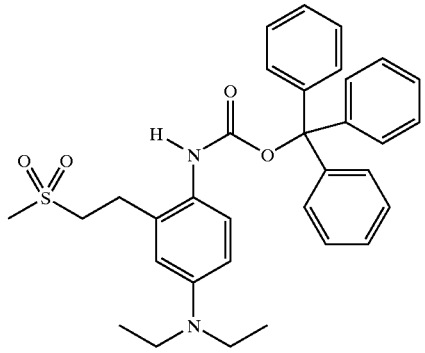

D-2

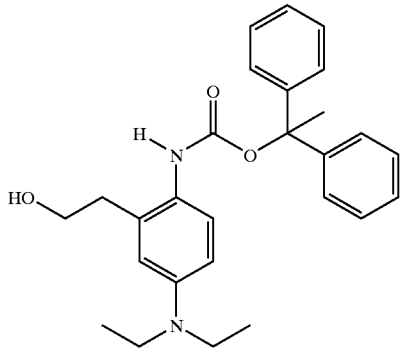

-continued
D-3
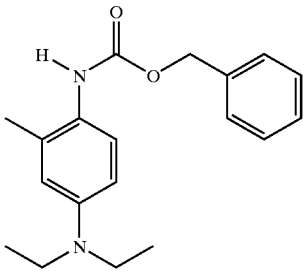
D-4
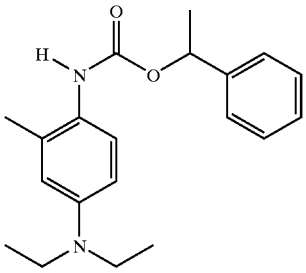
D-5
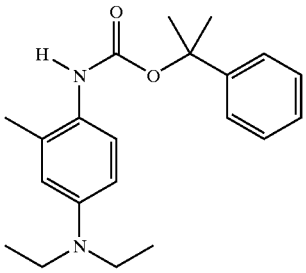
D-6
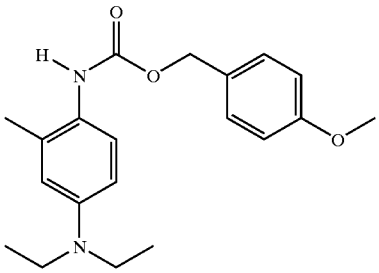
D-7
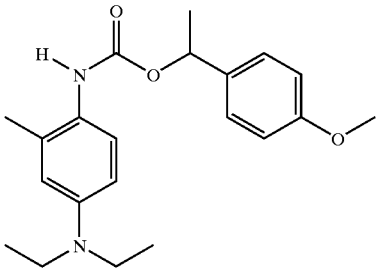
-continued
D-8
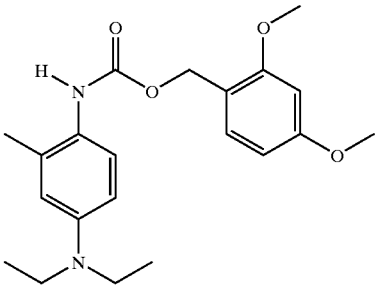
D-9
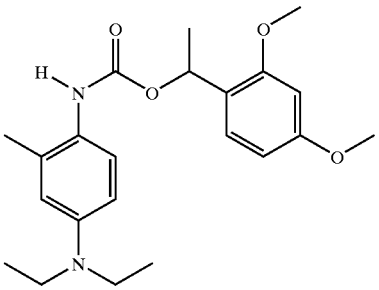
D-10
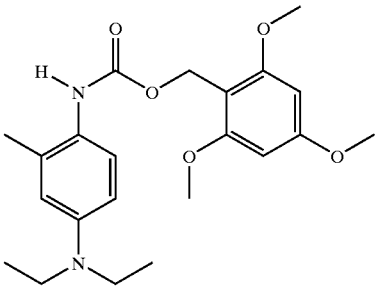
D-11
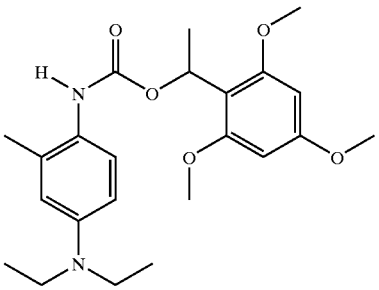
D-12
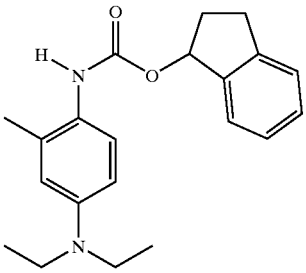

-continued
D-13
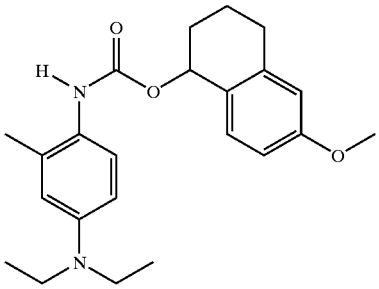
D-14
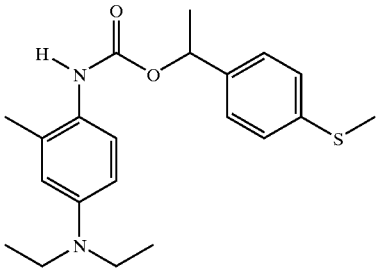
D-15
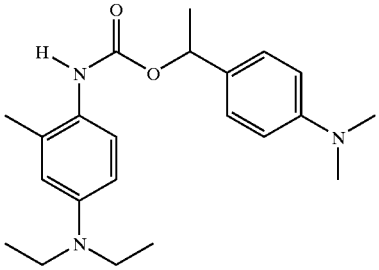
D-16
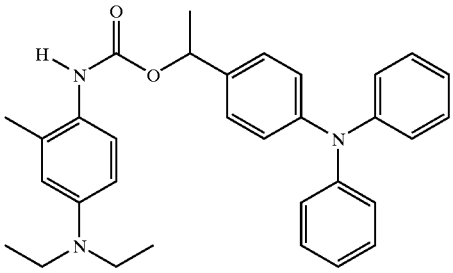
D-17
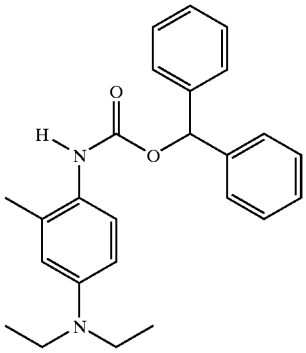
-continued
D-18
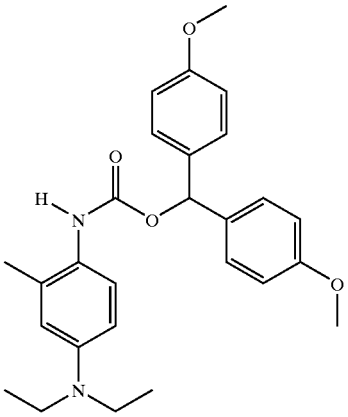
D-19
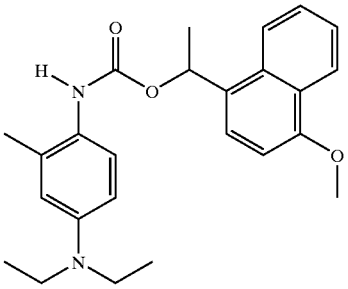
D-20
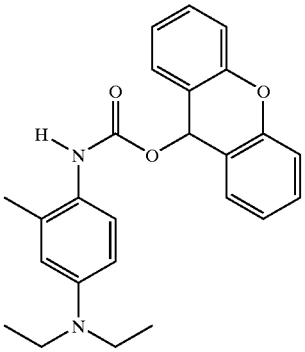
D-21
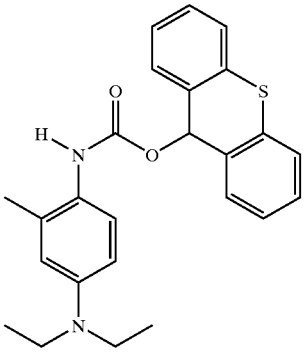

-continued
D-22
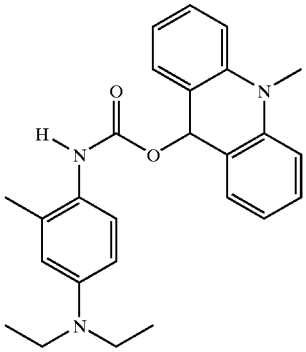
D-23
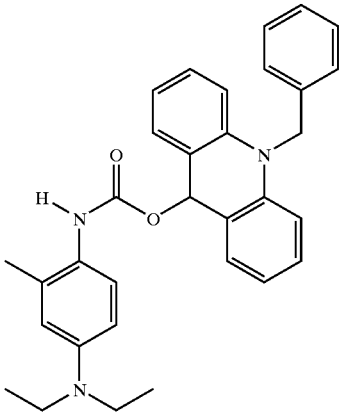
D-24
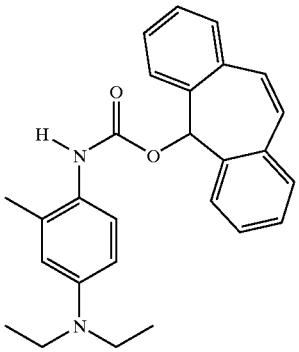
D-25
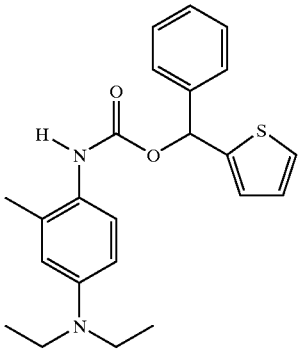
-continued
D-26
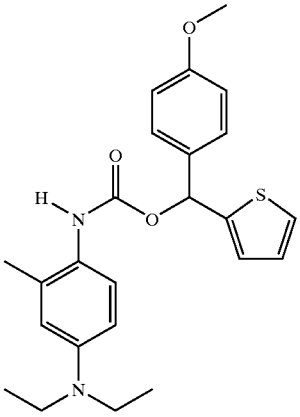
D-29
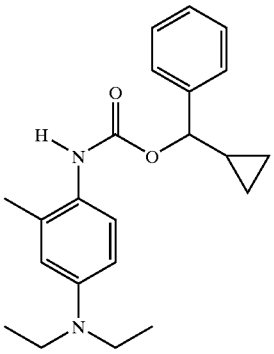
D-30
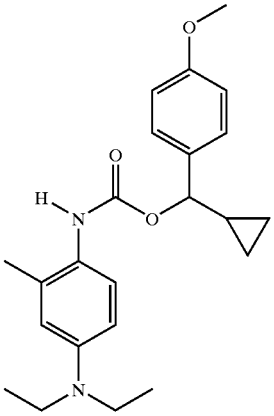
D-32
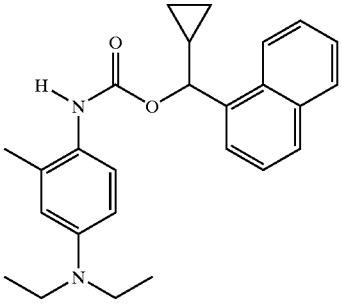

-continued
D-33
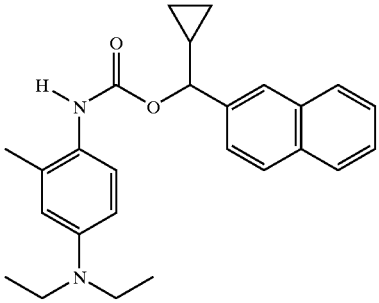
D-34
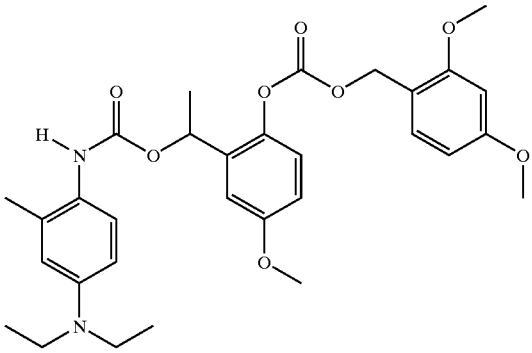
D-35
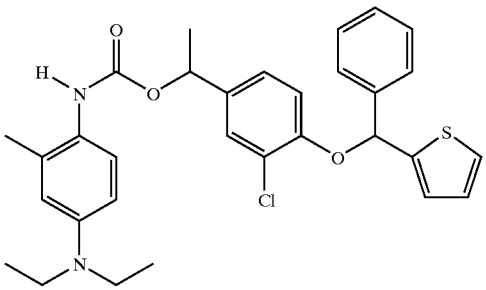
Some examples of monomers (M1 to M 12) for making the polymeric benzylically blocked developers and, respectively, the corresponding polymeric blocked developers (PBD1 to PBD12) made from the monomers, are as follows:
M1
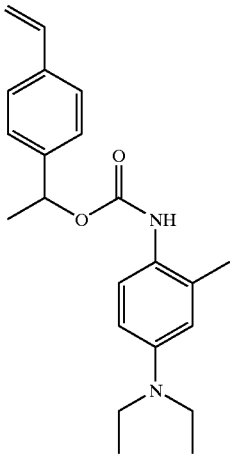
-continued
M2
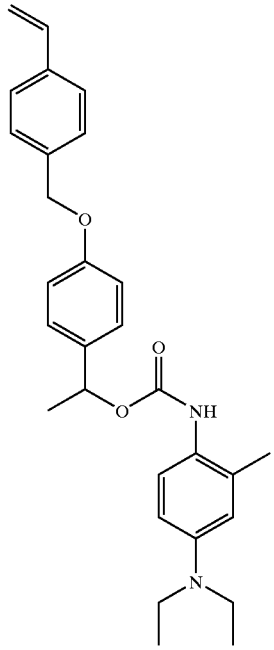
M3
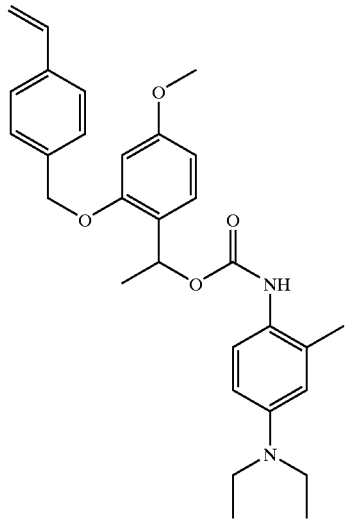
M4
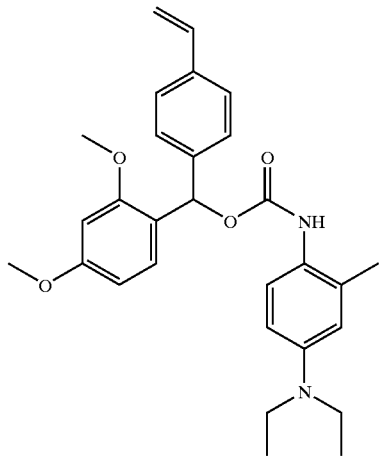

-continued
M5
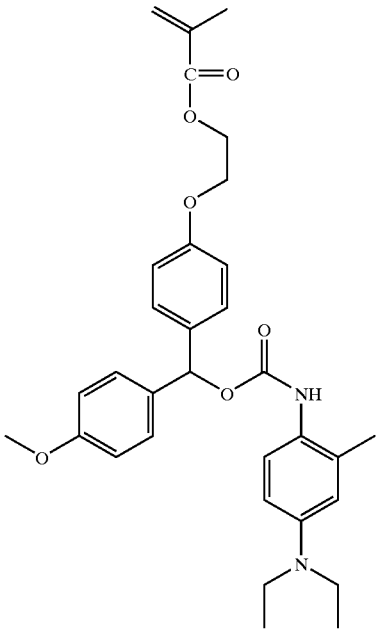
M6
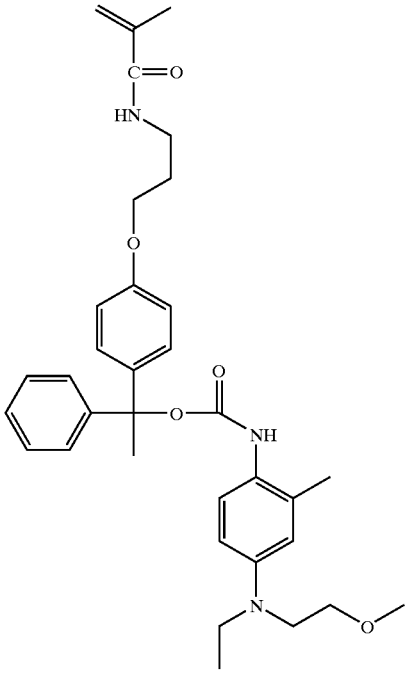
-continued
M7
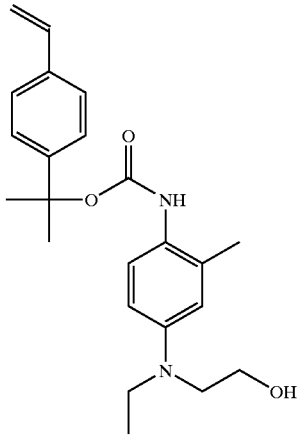
M8
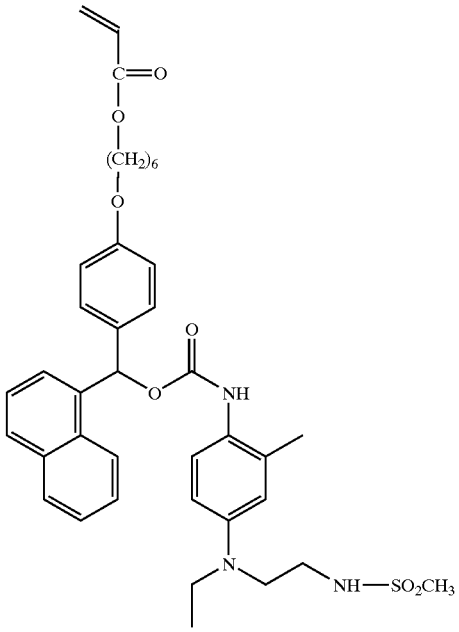
M9
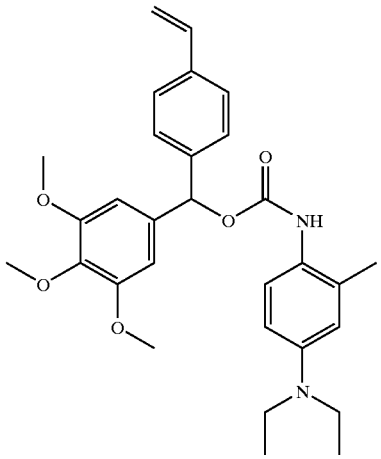

-continued
M10
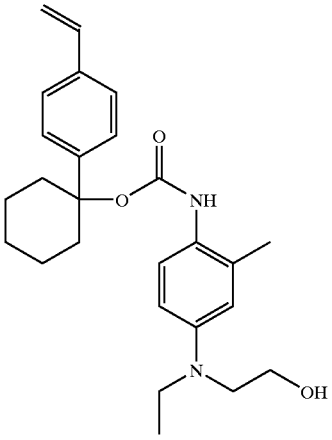
M11
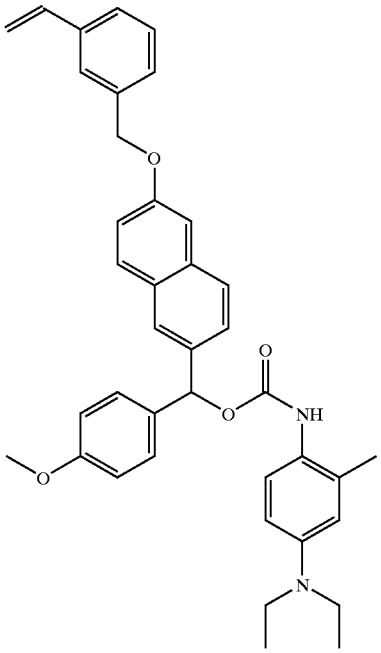
M12
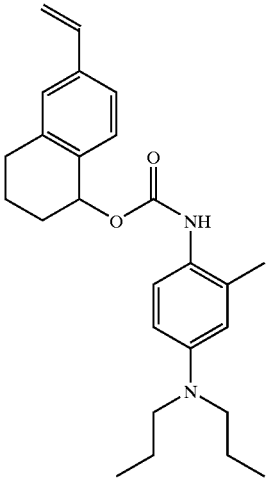
Polymeric Blocked Developers
PBD1
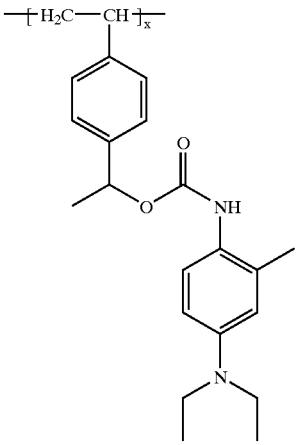
PBD2
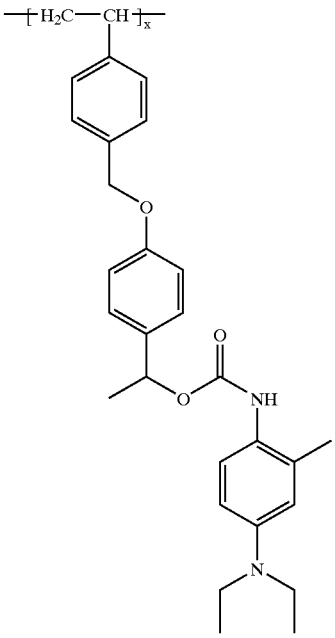
PBD3
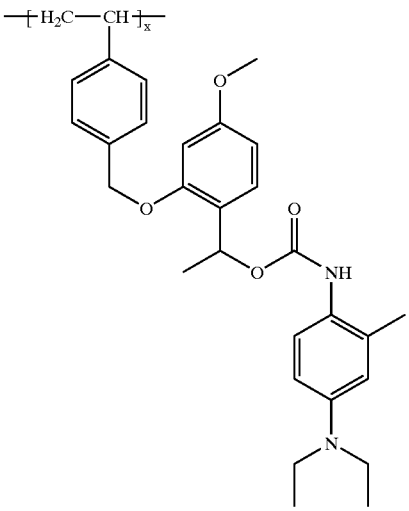

-continued
PBD4
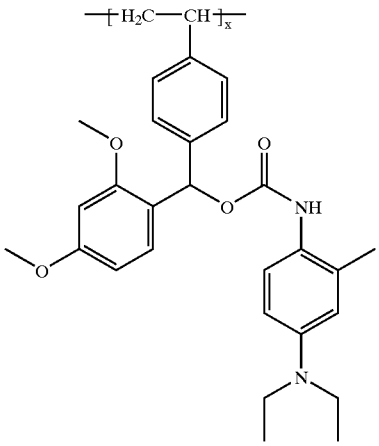
PBD5
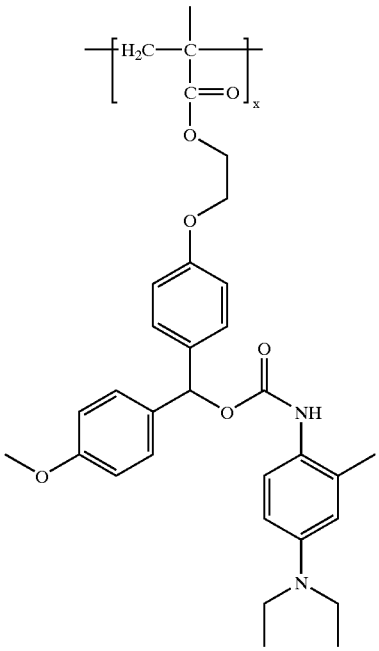
-continued
PBD6
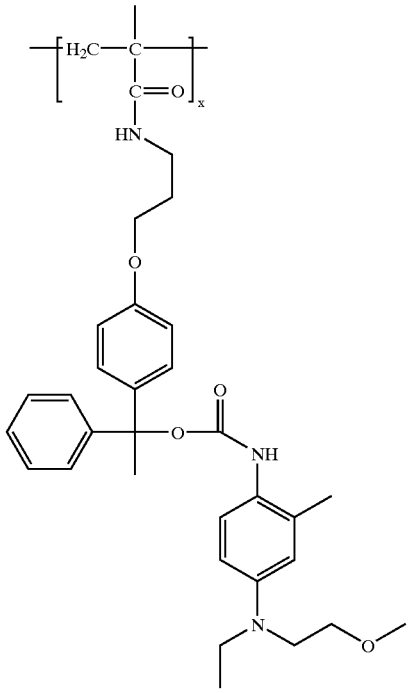
PBD7
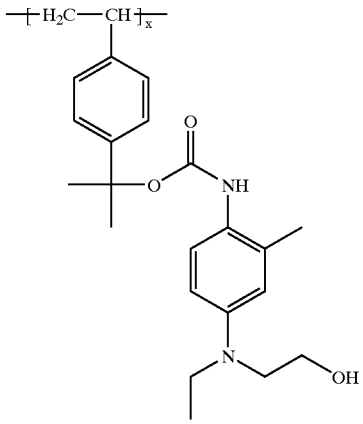

-continued

PBD8

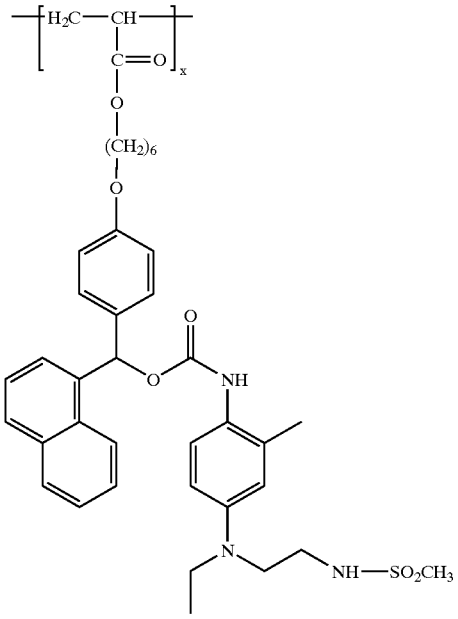

PBD9

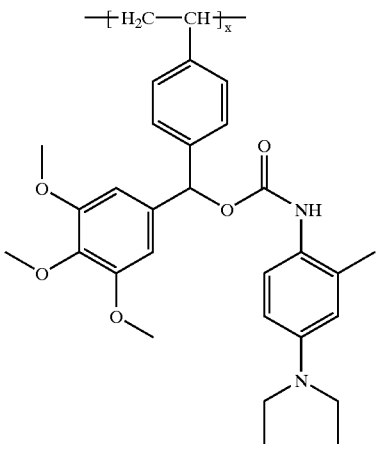

PBD10

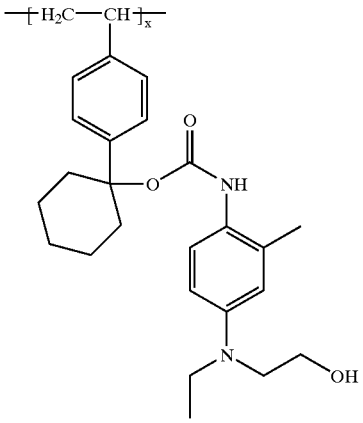

-continued

PBD11

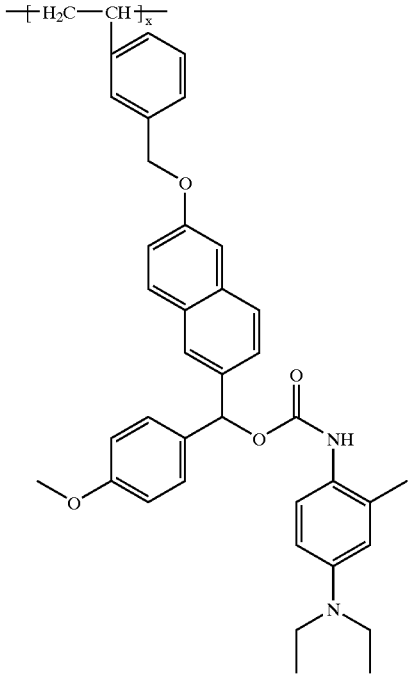

PBD12

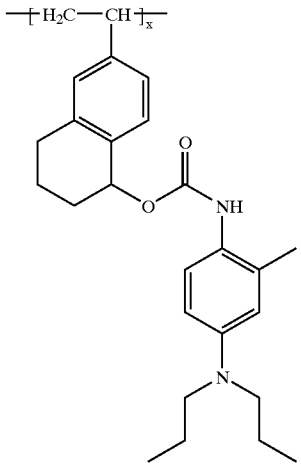

The blocked developer is preferably incorporated in one or more of the imaging layers of the imaging element. The amount of blocked developer used is preferably 0.01 to 5 $g/m^2$, more preferably 0.1 to 2 $g/m^2$ and most preferably 0.3 to 2 $g/m^2$ in each layer to which it is added. These may be color forming or non-color forming layers of the element. The blocked developer can be contained in a separate element that is contacted to the photographic element during processing.

After image-wise exposure of the imaging element, the blocked developer is activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxyl amine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

The blocked compounds may be used in any form of photographic system. A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure* I.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methaciylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure* I, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D+A$ log E) by doubling changes in density ($\Delta D$). Thus, gamma's as low as 1.0 or even 0.6 are contemplated and exposure latitudes of up to about 5.0 log E or higher are feasible. Gammas of about 0.55 are preferred. Gammas of between about 0.4 and 0.5 are especially preferred.

Instead of employing dye-forming couplers, any of the conventional incorporated dye image generating compounds employed in nulticolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure* I, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure*, Vol. 176, December 1978, Item 17643, XXIII. Image transfer systems.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1. 15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one time use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

The blocked compounds of this invention may be used in photographic elements that contain any or all of the features discussed above, but are intended for different forms of processing. These types of systems will be described in detail below.

Type I: Thermal process systems (thermographic and photothermographic), where processing is initiated solely by the application of heat to the imaging element.

Type II: Low volume systems, where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing.

Type III: Conventional photographic systems, where film elements are processed by contact with conventional photographic processing solutions, and the volume of such solutions is very large in comparison to the volume of the imaging layer.

Types I, II and III will now be discussed.

Type I: Thermographic and Photothermographic Systems

In accordance with one aspect of this invention the blocked developer is incorporated in a photothermographic element. Photothermographic elements of the type described in *Research Disclosure* 17029 are included by reference. The photothermographic elements may be of type A or type B as disclosed in *Research Disclosure* I. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

The photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gal late, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123, 274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

A reducing agent in addition to the blocked developer may be included. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a toning agent, also known as an activator-toner or toner-accelerator. (These may also function as thermal solvents or melt formers.) Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent application Ser. Nos. 09/206,586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent application Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In accordance with one aspect of this invention the blocked developer is incorporated in a thermographic element. In thermographic elements an image is formed by imagewise heating the element. Such elements are described in, for example, *Research Disclosure*, June 1978, Item No. 17029 and U.S. Pat. Nos. 3,080,254, 3,457,075 and 3,933,508, the disclosures or which are incorporated herein by reference. The thermal energy source and means for imaging can be any imagewise thermal exposure source and means that are known in the thermographic imaging art. The thermographic imaging means can be, for example, an infrared heating means, laser, microwave heating means or the like.

Type II: Low Volume Processing:

In accordance with another aspect of this invention the blocked developer is incorporated in a photographic element intended for low volume processing. Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

The Type II photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an to element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Type III: Conventional Systems:

In accordance with another aspect of this invention the blocked developer is incorporated in a conventional photographic element.

Conventional photographic elements in accordance with the invention can be processed in any of a number of well-known photographic processes utilizing any of a number of well-known conventional photographic processing solutions, described, for example, in *Research Disclosure* I, or in T. H. James, editor, *The Theory of the Photographic Process*, 4th Edition, Macmillan, New York, 1977. The development process may take place for any length of time and any process temperature that is suitable to render an acceptable image. In these cases the presence of blocked developers of the invention may be used to provide development in one or more color records of the element, supplementary to the development provided by the developer in the processing solution to give improved signal in a shorter time of development or with lowered laydowns of imaging materials, or to give balanced development in all color records. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development may be followed by bleach-fixing, to remove silver or silver halide, washing and drying.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with calorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649;260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe el al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979.027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

FIG. 1 shows, in block diagram form, the manner in which the image information provided by the color negative elements of the invention is contemplated to be used. An image scanner 2 is used to scan by transmission an image-wise exposed and photographically processed color negative element 1 according to the invention. The scanning beam is most conveniently a beam of white light that is split after passage through the layer units and passed through filters to create separate image records-red recording layer unit image record (R), green recording layer unit image record (G), and blue recording layer unit image record (B). Instead of splitting the beam, blue, green, and red filters can be sequentially caused to intersect the beam at each pixel location. In still another scanning variation, separate blue, green, and red light beams, as produced by a collection of light emitting diodes, can be directed at each pixel location. As the element 1 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 4, and the information is transformed into an electronic form R', G', and B', which can be stored in any convenient storage device 5.

In motion imaging industries, a common approach is to transfer the color negative film information into a video signal using a telecine transfer device. Two types of telecine transfer devices are most common: (1) a flying spot scanner using photomultiplier tube detectors or (2) CCD's as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 6, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 3, which can include a keyboard and cursor, enabling the workstation operator to provide image manipulation commands for modifying the video image displayed and any image to be recreated from the digital image information.

Any modifications of the image can be viewed as they are being introduced on the video display 6 and stored in the storage device 5. The modified image information R'", G'", and B'" can be sent to an output device 7 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 8 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 1, the images contained in color negative elements in accordance with the invention are converted to digital form, manipulated, and recreated in a viewable form. Color negative recording materials according to the invention can be used with any of the suitable methods described in U.S. Pat. No. 5,257,030. In one preferred embodiment, Giorgianni et al provides for a method and means to convert the R, G, and B image-bearing signals from a transmission scanner to an image manipulation and/or storage metric which corresponds to the trichromatic signals of a reference image-producing device such as a film or paper-writer, thermal printer, video display, etc. The metric values correspond to those which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data-set is generated from which the mathematical transformations to convert R, G, and B image-bearing signals to the aforementioned code values are derived. Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by transmission scanner which produces R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may consist of a sequence of matrix operations and look-up tables (LUT's).

Figure 2:
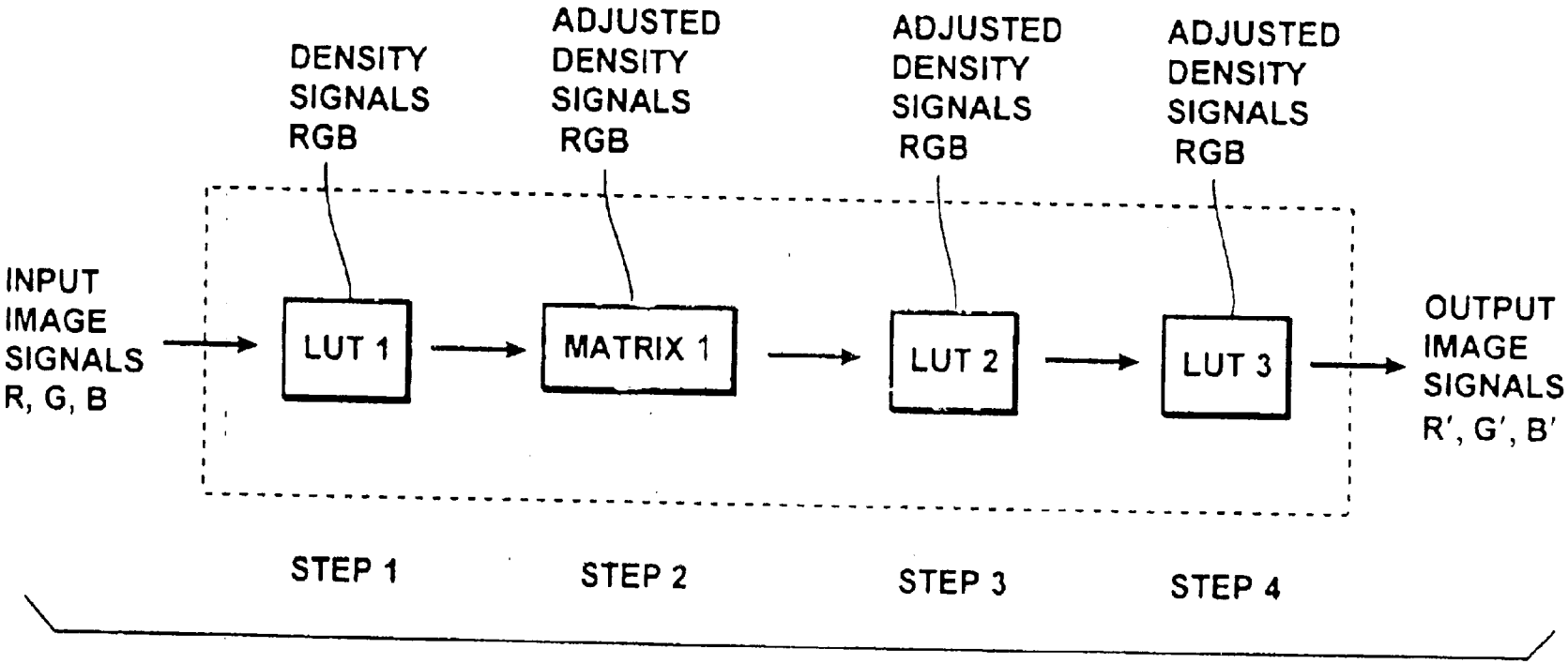
FIG. 2 shows a block diagram showing electronic signal processing of image bearing signals derived from scanning a developed color element according to the invention.

Referring to FIG. 2, in a preferred embodiment of the present invention, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described by D'Errico at U.S. Pat. No. 4,941,039. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred embodiment of the invention, the R, G, and B image-bearing signals from a transmission scanner are converted to an image manipulation and/or storage metric which corresponds to a measurement or description of a single reference image-recording device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured RGB densities of that reference film, then for an input color negative film according to the invention, the R, G, and B image-bearing signals from a scanner would be transformed to the R', G', and B' density values corresponding to those of an image which would have been formed by the reference color negative film had it been exposed under the same conditions under which the color negative recording material according to the invention was exposed.

Exposure patterns, chosen to adequately sample and cover the useful exposure range of the film being calibrated, are created by exposing a pattern generator and are fed to an exposing apparatus. The exposing apparatus produces trichromatic exposures on film to create test images consisting of approximately 150 color patches. Test images may be created using a variety of methods appropriate for the application. These methods include: using exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The exposed film is processed chemically. Film color patches are read by a transmission scanner which produces R, G, and B image-bearing signals corresponding each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed.

Thus, each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may consist of a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs. In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale. In another preferred embodiment, LUT 3 of step 4 transforms the intermediary image-bearing signals according to a modified viewing tone scale that is more pleasing, such as possessing lower image contrast.

Due to the complexity of these transformations, it should be noted that the transformation from R, G, and B to R', G', and B' may often be better accomplished by a 3-dimensional LUT. Such 3-dimensional LUTs may be developed according to the teachings J. D'Errico in U.S. Pat. No. 4,941,039.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

In yet another embodiment of the invention, the luminance and chrominance sensitization and image extraction article and method described by Arakawa et al in U.S. Pat. No. 5,962,205 can be employed. The disclosures of Arakawa et al are incorporated by reference.

EXAMPLE 1

This Example illustrates the synthesis of polymeric blocked developer PBDI. First, 4-(1-hydroxyethyl)styrene was prepared. A suspension of 4.82 g (0.198 mol) of magnesium in 200 mL of dry tetrahydrofuran (THF) under nitrogen was treated with 36.3 g (0.198 mmol) of 4-bromostyrene plus a trace of iodine. The reaction, mixture was heated at reflux for 4 h, and then cooled using an ice bath. Acetaldehyde (9.6 g, 0.218 mol) was added, and the mixture was stirred overnight. The reaction mixture was poured onto 300 g of ice plus 25 g of ammonium chloride, and then extracted with ether (3×200 mL). The combined ethereal extracts were concentrated, and the residue was vacuum distilled. The product (17.3 g, 59%) was obtained as a slightly yellow, bp 67–99° C./0.10 mm. $^1$H NMR ($CDCl_3$) δ 1.50 (d, J=6.4, 3H), 1.8 (br s, 1H), 4.89 (q, J=6.4, 1H), 5.24 (d, J=11.0, 1H), 5.74 (d, J=17.7, 1H), 6.7 (m, 1H), 7.34 (d, J=8.2, 2H), 7.40 (d, J=8.2, 2H).

Next, Monomer M1 was synthesized. A mixture of 17.3 g (0.117 mol) of 4-(1-hydroxyethyl)styrene, 23.84 g (0.117 mol) of N,N-diethyl-4-isocyanato-m-toluidine, and four drops of dibutyl tin diacetate in 150 mL of dry THF under nitrogen was refluxed for 16 h. After cooling to room temperature, the reaction mixture was filtered to remove a small amount of white solid by-product, and concentrated to deposit a tan oil that gradually crystallized. The product was recrystallized from heptane, utilizing a little silica gel as decolorant, to produce 26.9 g (65%) of a cream colored powder, mp 74–6° C. An additional 4.6 g (11%) of product was recovered as a second crop by partial concentration of the mother liquor, filtration, and then repeated recrystallization from heptane. $^1$H NMR ($CDCl_3$) δ 1.14 (t, J=7.0, 6H), 1.58 (d, J=6.9, 3H), 2.20 (s, 3H), 3.32 (q, J=7.0, 4H), 5.24 (d, J=10.8, 1H), 5.74 (d, J=17.6, 1H), 5.88 (q, J=6.6, 1H), 6.13 (br s, 1H), 6.5 (m, 2H), 6.7 (m, 1H), 7.4 (m, 5H).

Finally, Polymeric Blocked Developer PBD1 was prepared as follows: A solution of 1.50 g (4 mmol) of Monomer M1, 0.014 g (0.08 mmol) of 2,2'-azobis(2-methylbutyronitrile) in 15 mL of chlorobenzene was degassed by purging with nitrogen for 10 min, and then heated at 60° C. for 16 h, and then cooled to room temperature. The polymer was precipitated into 200 mL of methanol, depositing a solid mass. The supernatant was decanted, and the solid was dried in vacuo. The polymer was reprecipitated successively from THF into ligroin, producing 0.65 g (41%)

of a white powder. The polymer was characterized by Size Exclusion Chromatography (SEC) in N,N-dimethylformamide (DMF), using poly(ethylene oxide) (PEO) calibration: $\overline{M}_n$=11,200; $\overline{M}_w$=26,200, and by Differential Scanning Calorimetry (DSC): Tg=93° C.

EXAMPLE 2

This Example illustrates the synthesis of polymeric blocked developer PBD2. First, 4-(4-acetylphenoxy)methyl) styrene was synthesized. Sodium hydride (3.7 g of 60% dispersion in mineral oil 92 mmol) under nitrogen was washed with ligroin (3×25 mL), and then treated dropwise with a solution of 10.0 g (73 mmol) of 4-hydroxyacetophenone dissolved in 50 mL of DMF with mechanical stirring. 4-Vinylbenzyl chloride (11.2 g, 73 mmol) was added slowly, and the resulting mixture was stirred at 110° C. for 17 h. Upon cooling the reaction mixture to room temperature, some the product crystallized. This material was collected, washed with cold methanol, and recrystallized from isopropanol to produce 3.6 g (19%) of product. Additional product (5.5 g, 30%) was obtained by concentrating the combined filtrates, and recrystallizing successively from isopropanol and then heptane. The product was characterized by NMR and mass spectroscopy: $^1$H NMR ($CDCl_3$) δ 2.55 (s, 3H), 5.12 (s, 2H), 5.28 (d, J=10.9, 1H), 5.77 (d, J=17.6, 1H), 6.75 (m, 1H), 7.01 (d, J=8.8, 2H), 7.41 (AB q, J=8.2, Δv=24.0, 4H), 7.94 (d, J=8.8, 2H). Electrospray mass spectrometry (ES-MS) m/e 253 ($M^+$+1).

Next, 4-(4-(1-hydroxyethyl)phenoxy)methylstyrene was prepared. A mixture of 3.00 g (32 mmol) of 4-(4-acetylphenoxy)methyl)styrene, 1.20 g (32 mmol) of sodium borohydride, and 75 mL of isopropanol was stirred magnetically at reflux for 30 min. The reaction mixture was cooled to room temperature and poured slowly into 500 mL of water. The resulting suspension was acidified by the dropwise addition of 10% HCl. The precipitated product was collected, washed with water, and air-dried. The product was recrystallized from heptane to deposit 6.6 g (82%) of white crystals. $^1$H NMR ($CDCl_3$) 8 1.48 (d, J=6.4, 3H), 1.73 (s, 1H), 4.86 (q, J=6.4, 1H), 5.06 (s, 2H), 5.26 (d, J=10.9, 1H), 5.76 (d, J=17.6, 1H), 6.73 (m, 1H), 6.96 (d, J=8.6, 2H), 7.30 (d, J=8.8, 2H), 7.41 (AB q, J=8.3, Δv=19.2, 4H). ES-MS m/e 237 ($M^+$−$H_2O$+1).

Next, Monomer M2 was prepared. A mixture of 6.60 g (26 mmol) of 4-(4-(1-hydroxyethyl)phenoxy)methylstyrene, 5.30 g (26 mmol) of N,N-diethyl-4-isocyanato-m-toluidine, and three drops of dibutyl tin diacetate in 50 mL of dry dichloromethane under nitrogen was help at room temperature for 24 h. The reaction mixture was filtered and concentrated to deposit a tan oil that gradually crystallized. The product was recrystallized from heptane (200 mL), utilizing a little alumina as decolorant, and then from methanol (125 mL) to produce 7.8 g (66%) of a cream colored powder. $^1$H NMR ($CDCl_3$, )δ 1.13 (t, J=7.0, 6H), 1.57 (d, J=8.0, 3H), 2.18 (s, 3H), 3.31 (q, J=7.0, 4H), 5.05 (s, 2H), 5.26 (d, J=10.9, 1H), 5.76 (d, J=d, J=17.6, 1H), 5.85 (q, J=6.5, 1H), 6.09 (br s, 1H), 6.5 (m, 2H), 6.7 (m, 1H), 6.95 (d, J=8.6, 2H), 7.32 (br m, 3H), 7.41 (AB q, J=8.3, Δv=19.7, 4H). ES-MS m/e 459 ($M^+$+1).

Finally, Polymeric Blocked Developer PBD2 was prepared as follows: A solution of 7.60 g (17 mmol) of Monomer M2, 0.032 g (0.2 mmol) of 2,2'-azobis(2-methylbutyronitrile) in 50 mL of chlorobenzene was degassed by purging with nitrogen for 10 min, and then heated at 65° C. for 18 h, and then cooled to room temperature. The polymer was precipitated into 750 mL of methanol, depositing a solid mass. The supernatant was decanted, and the solid was dried in vacuo. The polymer was reprecipitated successively from THF into isopropanol and then from THF into ligroin, producing 4.4 g (58%) of a cream-colored powder. The polymer was characterized by SEC in DMF, using PEO calibration: $\overline{M}_n$=33,400; $\overline{M}_w$=202,000, and by DSC: Tg=83° C.

EXAMPLE 3

This Example illustrates the synthesis of polymeric blocked developer PBD3. First, 4-(2-acetyl-5-methoxyphenoxy)methyl)styrene was prepared. A mixture of 5.07 g (31 mmol) of 2-hydroxy-4-methoxyacetophenone, 5.01 g (33 mmol) of 4-chloromethylstyrene, 10.1 g (31 mmol) of cesium carbonate, and 200 mL of acetonitrile were heated at reflux for 18 h. The reaction mixture was cooled to room temperature and the solvent stripped to deposit 7.80 g (84%) of solid product. $^1$H NMR ($CDCl_3$) δ 2.56 (s, 3H), 3.83 (s, 3H), 5.12 (s, 2H), 5.28 (d, J=10.9, 1H), 5.78 (d, J=17.6, 1H), 6.52 (s, 1H), 6.54 (d, J=8.9, 1H), 6,75 (m, 1H), 7.42 (AB q, J=8.3, Δv=20.5, 4H). ES-MS m/e 283 ($M^+$+1).

Next, 4-(2-(1-hydroxyethyl)-5-methoxyphenoxy) methylstyrene was prepared. A mixture of 17.5 g (62 mmol) of 4-(2-acetyl-5-methoxyphenoxy)methyl)styrene, 2.58 g (68 mmol) of sodium borohydride, and 100 mL of isopropanol was stirred magnetically and heated at reflux for 30 min. The reaction mixture was cooled to room temperature, and poured slowly onto a mixture of 500 g of ice and 25 mL of acetic acid. The resulting white precipitate was collected, washed with water, and dried. The product was recrystallized from a mixture of toluene and heptane (20/80 v/v). An off-white solid was obtained, 15.0 g (85%). $^1$H NMR ($CDCl_3$) δ 1.50 (d, J=6.5, 3H), 2.45 (br s, 1H), 3.79 (s, 3H), 5.07 (s, 2H), 5.10 (q, 6.5, 1H), 5.27 (d, J=10.8, 1H), 5.77 (d, J=17.6, 1H), 6.55 (m, 2H), 6.73 (m, 1H), 7.27 (d, J=8.6, 1H), 7.41 (AB q, J=8.2, Δv=26.4, 4H). FD-MS m/e 284 ($M^+$).

Next, Monomer M3 was synthesized. A mixture of 15.0 g (53 mmol) of 4-(2-(1-hydroxyethyl)-5-methoxyphenoxy) methylstyrene, 10.8 g (53 mmol) of N,N-diethyl-4-isocyanato-m-toluidine, 100 mL of dichloromethane, and four drops of dibutyl tin diacetate was stirred magnetically at room temperature for 3 d. The reaction mixture was concentrated to deposit a brown oil that gradually solidified. The product was twice recrystallized from 100 mL of 70/30 (v/v) toluene/heptane to provide 9.5 g (37%) of a light yellow powder. An additional 3.9 g (15%) of product was obtained by concentrating the mother liquors and repeating the two recrystallizations. $^1$H NMR ($CDCl_3$) δ 1.14 (t, J=7.0, 6H), 1.57 (d, J=6.4, 3H), 2.19 (s, 3H), 3.30 (q, J=7.0, 4H), 3.78 (s, 3H), 5.09 (s, 2H), 525 (d, J=10.9, 1H), 5,75 (d, J=17.6, 1H), 6.1 (br s, 1H), 6.26 (q, J=6.5, 1H), 6.5 (m, 4H), 6.7 (br m, 2H), 7.41 (s, 4H). ES-MS m/e 489 ($M^+$+1).

Finally, Polymeric Blocked Developer PBD3 was prepared as follows: A flask was charged with 5.00 g (10 mmol) of Monomer M3, 0.039 g (0.2 mmol) of 2,2'-azobis(2-methylbutyronitrile), and 35 mL of chlorobenzene. The resulting solution was degassed by purging with nitrogen for 10 min, and then the flask was sealed with a septum. The reaction mixture was heated in a 65° C. water bath for 24 h, and then cooled to room temperature. The polymer was precipitated into 700 mL of methanol, depositing a solid mass. The supernatant. was decanted, and the solid was dried in vacuo. The polymer was reprecipitated from dichloromethane (50 mL) into ligroin (700 mL), producing 2.3 g (46%) of a white powder. The polymer was characterized by SEC in DMF, using PEO calibration: $\overline{M}_n$=13,800; $\overline{M}_w$=28,800, and by DSC: Tg=89° C.

EXAMPLE 4

This Example illustrates the synthesis of polymeric blocked developer PBD4. First, α-4-ethenylphenyl)-2,4-dimethoxybenzenemethanol was prepared. In a thoroughly dry flask, magnesium metal (1.33 g, 55 mmol) was treated with a catalytic amount of iodine under nitrogen with slight warming. Dry THF was added (25 mL), and the mixture stirred magnetically. A solution of 4-bromostyrene (10.0 g, 55 mmol) in 25 mL of dry THF was added dropwise, and then the reaction mixture was heated at reflux for 15 min. The mixture was cooled in an ice bath, and a solution of 9.08 g (55 mmol) of 2,4-dimethozybenzaldehyde in 50 mL of dry THF was added slowly. To this yellow, heterogeneous mixture was added 100 mL of saturated aqueous ammonium chloride, and then the mixture was extracted with ether (3×75 mL). The combined ethereal extracts were dried ($Na_2SO_4$) and concentrated at reduced pressure to deposit a yellow oil. The oil was triturated with ligroin, and stored overnight at −15° C. to crystallize. The ligroin was decanted, and the solid residue was recrystallized from 80% heptane/20% toluene to produce, after drying in vacuo, 10.4 g (70%) of white crystals. $^1$H NMR ($CDCl_3$) δ 2.88 (d, J=5.2, 1H), 3.80 (s, 6H), 5.22 (d, J=11.0, 1H), 5.73 (d, J=17.5, 1H), 6.0 (d, J=5.1, 1H), 7.35 (AB q, J=8.5, Δv=17.4, 4H). ES-MS m/e $253^+$ (M+1-$H_2O$). FD-MS m/e $270^+$ (M).

Next, Monomer M4 was prepared. A solution of 10.4 g (38 mmol) of □-(4-ethenylphenyl)-2,4-dimethoxybenzenemethanol, 7.86 g (38 mmol) of N,N-diethyl-4-isocyanato-m-toluidine, and 5 drops of dibutyl tin diacetate in 100 mL of dry dichloromethane was stirred at 25° C. for 48 h, and then concentrated at reduced pressure. The resulting solid was twice recrystallized from 60% toluene/40% heptane to produce 8.7 g (48%) of a yellow powder. $^1$H NMR ($CDCl_3$) δ 1.13 (t, J=7.0, 6H), 2.19 (s, 3H), 3.31 (q, J=6.9, 4H), 3.80 (s, 6H), 5.22 (d, J=10.9, 1H), 5.71 (d, J=17.6, 1H), 6.2 (br s, 1H), 6.6 (m, 4H), 6.7 (m, 1H), 7.15 (s, 1H), 7.2 (m, 1H), 7.35 (m, 4H). ES-MS m/e $475^+$ (M+1).

Finally, Polymeric Blocked Developer PBD4 was prepared as follows: A solution of 8.70 g (19 mmol) of Monomer M4 and 0.036 g (0.19 mmol) of 2,2'-azobis[2-methylbutanenitrile] in 40 mL of chlorobenzene was de-aerated by purging with nitrogen for 10 min, and then held at 70° C. for 20 h. The solution was cooled to ambient, and the polymer was precipitated into excess methanol. The collected polymer was air-dried, and then reprecipitated from dichloromethane into ligroin. After drying in vacuo at 60° C., 2.7 g (31%) of a cream colored powder was obtained. The polymer was characterized by SEC in DMF, using PEO calibration: $\overline{M}_n$=16,100; $\overline{M}_w$=57,800, and by DSC: Tg=117° C.

EXAMPLE 5

This Example illustrates the preparation of evaporative limited coalescence dispersion of polymeric blocked developer PBD3. The organic phase was formed by polymerizing 5 g of M3 in 45 mL of deaerated ethyl acetate using 1 mol % of 2,2'-azobis(2-methylbutanenitrile) initiator for 48 h 60° C. The aqueous phase comprised 130 mL of pH=4 buffer, 3 mL of colloidal silica dispersion, and 0.4 mL of 10% aqueous poly(methylaminoethanol adipate) promoter. The organic phase was stirred in a homogenizer at full motor speed, and the aqueous phase was added quickly. The mixture was homogenized for 5 min, and then passed twice through a microfluidizer. The ethyl acetate was removed by rotary evaporation. The dispersed beads were isolated by centrifugation (500 rpm for 15 min). The supernatant was decanted, and the beads re-suspended in de-aerated water. The centrifugation and decantation was repeated twice, eventually producing a clean dispersion. Particle sizes were observed by microscopy, typically 1–6 μm.

This example demonstrates the ease by which aqueous dispersions of a polymeric blocked developer can be prepared.

EXAMPLE 6

This Example illustrates the synthesis of polymeric blocked developer containing styrene as an optional comonomer. A solution of 1.50 g (3.1 mmol) of Monomer M3, 1.50 g (14 mmol) of styrene, and 0.067 g (0.35 mmol) of 2,2'-azobis[2-methylbutanenitrile] in 20 mL of chlorobenzene was de-aerated by purging with nitrogen for 10 min, and then held at 65° C. for 24 h. The solution was cooled to ambient, and the polymer was precipitated into excess methanol. The collected polymer was air-dried, and then reprecipitated from dichloromethane into ligroin. After drying in vacuo at 60° C., 0.9 g (30%) of a cream colored powder was obtained. The polymer was characterized by SEC in DMF, using PEO calibration: $\overline{M}_n$=5,900; $\overline{M}_w$=10,300, and by DSC: Tg=97 C.

EXAMPLE 7

This Example illustrates the synthesis of polymeric blocked developer containing methyl methacrylate as an optional comonomer. A solution of 1.50 g (3.1 mmol) of Monomer M3, 1.5 g (15 mmol) of methyl methacrylate, and 0.069 g (0.36 mmol) of 2,2'-azobis[2-methylbutanenitrile] in 20 mL of chlorobenzene was de-aerated by purging with nitrogen for 10 min, and then held at 65° C. for 24 h. The solution was cooled to ambient, and the polymer was precipitated into excess methanol. The collected polymer was air-dried, and then reprecipitated from dichloromethane into ligroin. After drying in vacuo at 60° C., 1.6 g (53%) of a cream colored powder was obtained. The polymer was characterized by SEC in DMF, using PEO calibration: $\overline{M}_q$=13,000; $\overline{M}_w$=28,700, and by DSC: Tg=95 C.

EXAMPLE 8

This Example illustrates the synthesis of polymeric blocked developer containing 2-hydroxyethyl methacrylate as an optional comonomer. A solution of 1.35 g (2.8 mmol) of Monomer M3, 1.35 g (10 mmol) of 2-hydroxyethyl methacrylate, and 0.05 g (0.26 mmol) of 2,2'-azobis[2-methylbutanenitrile] in 20 mL of DMF was de-aerated by purging with nitrogen for 10 min, and then held at 65° C. for 20 h. The solution was cooled to ambient, and the polymer was precipitated into excess methanol. The collected polymer was air-dried, and then reprecipitated from dichloromethane into ligroin. After drying in vacuo at 60° C., 2.7 g (100%) of a cream colored powder was obtained. The polymer was characterized by SEC in DMF, using PEO calibration: $\overline{M}_n$=26,600; $\overline{M}_w$=59,900, and by DSC: Tg=102° C.

EXAMPLE 9

The polymeric blocked developer PBD2 (Example 2) of blocked developer D-7 above (patented in U.S. Pat. No. 6,312,879, hereby incorporated by reference) was evaluated in photothermographic handcoatings using the following format. The polymeric developer was included as a component of a gelatin layer (0.4 g/ft$^2$) coated on a transparent polyester film-base. Other components were a blue-light sensitized silver bromoiodide emulsion (0.6×0.09 micron, 0.05 g/ft$^2$); magenta image coupler (0.05 g/ft$^2$), a 1:0.5 by weight dispersion in tricresyl phosphate); the silver salt of benzotriazole (0.05 g/ft$^2$ as silver); 1-phenyl-5-mercaptotetrazole (0.03 g/ft$^2$, as a ball-milled dispersion); salicylanilide (0.08 g/ft$^2$, as a ball-milled dispersion) and surfactant (TX-200, 1%). The polymer PBD2 was dispersed by ball-milling. Dispersions were pH adjusted using 1 N nitric acid. The coatings were air-dried and no overcoat or hardener was used.

Strips of each coating were exposed through a step-wedge (1 s, 3.04 log lux light source at 3000K, 0–4 stepwedge, Wratten 2B filter, Daylight Va filter) and processed at a variety of temperatures using a 20 s residence time in a thermal processor using a platen heating element. The strips were then fixed using KODAK FLEXICOLOR Fix solution with low-agitation for 4 min at about 10° C. After washing (4 min at 10° C.) the strips were air-dried and the sensitometric responses at each temperature of development were read and recorded. The maximum green density was recorded for each strip, and the data are presented in Table 1, which shows the Maximum Green Density ($D_g$-max) of thermally processed handcoatings containing polymer PBD2.

TABLE 1

| Sample | Developer | pH of Dispersion prior to Coating | Process Temperature (° C.) | Green Dmax |
|---|---|---|---|---|
| 1-1 | PBD2 | 6.0 | 130 | 0.07 |
| 1-2 | PBD2 | 6.0 | 140 | 0.05 |
| 1-3 | PBD2 | 6.0 | 150 | 0.06 |
| 1-4 | PBD2 | 6.0 | 160 | 0.12 |
| 1-5 | PBD2 | 3.5 | 130 | 0.07 |
| 1-6 | PBD2 | 3.5 | 140 | 0.10 |
| 1-7 | PBD2 | 3.5 | 150 | 0.27 |
| 1-8 | PBD2 | 3.5 | 160 | 0.74 |

These data show that the polymeric blocked developer PBD2 is an effective developer in a photothermographic format, particularly at a low coating 20 pH.

EXAMPLE 10

In this example, the photothermographic performance of the polymeric blocked developer PBD3 (made from monomer M3, Example 3) was compared with its monomer and also with the known prior art coupler D7. The co-polymer made from M3 and 2-hydroxyethyl methacrylate (HEM, Example 8) was also included in the examples. Photothermographic single-layer coatings containing the developers were prepared on transparent polyester support. The developers were evaluated at equal molar levels (0.14 mmol/ft$^2$). Additional components as described in Example 9 were also present in each coating. The imaging layers had 0.4 mg/ft$^2$ gel. No pH adjustments were made to the melts prior to coating. Each sample also received a 300 mg/ft$^2$ gelatin overcoat, and the coatings were hardened with bis-vinylmethyl sulfone hardener, which was incorporated at 1.8% (w/w) of total gelatin.

Samples were exposed as described in Example 9, and the coatings were processed for 20 seconds at 150° C. using a thermal processor with a platen heating element. The strips were fixed and the minimum and maximum Status M green densities (Dmin and Dmax) were read with an X-Rite densitometer. The Relative Discrimination for each sample was then determined from the expression:

$$\text{Relative Discrimination}=(\text{Dmax}-\text{Dmin})/\text{Dmin}$$

The Relative Discrimination describes the ability of a photothermographic imaging layer to adequately distinguish exposed from unexposed areas, while still maintaining a low minimum density. Higher values of Relative Discrimination are desirable. The data for the samples of this Example 10 are presented in Table 2 below, which show photothermographic data for thermally processed (20 seconds at 150° C.) coatings containing polymeric blocked developers PBD3 of Example 3 and the-copolymer M7/HEM of Example 8.

TABLE 2

| Sample | Developer | Dmin | Dmax | Relative Discrimination |
|---|---|---|---|---|
| 2-1 | D7 (comparison) | 0.192 | 0.473 | 1.46 |
| 2-2 | M7 (comparison) | 1.558 | 2.362 | 0.51 |
| 2-3 | PBD3 (invention) | 0.297 | 1.218 | 3.10 |
| 2-4 | M7/HEM copolymer (invention) | 0.336 | 1.055 | 2.14 |

As the data in Table 2 clearly demonstrate, the polymeric developers PBD3 and the M7/HEM copolymer clearly perform better than the monomeric developers. The polymeric developers provide significantly lower Dmin and higher Relative Discrimination than the monomeric counterpart, M7. They also provide higher Dmax than the known prior art coupler D7.

EXAMPLE 11

The samples of this Example 11 were prepared identically to those of Example 9, with the exception that the 1-phenyl-5-mercaptotetrazole was incorporated as its silver salt (rather than as a free mercaptotetrazole) at 0.03 g/ft$^2$ of silver. The level of silver benzoltriazole was also reduced from 0.05 to 0.03 g Ag/ft$^2$. The handcoatings used the developers polymer PBD4 and polymer PBD3 at 0.07 g/ft$^2$. The coatings were exposed, processed, and fixed as previously described, and the photothermographic data for several processing temperatures (all @ 20 seconds residence time) are presented in Table 3 below,

TABLE 3

| Sample | Developer | Process Temperature (° C.) | Dmax |
|---|---|---|---|
| 3-1 | PBD3 | 140 | 0.717 |
| 3-2 | PBD3 | 150 | 1.006 |
| 3-3 | PBD3 | 160 | 1.66 |
| 3-4 | PBD3 | 170 | 2.51 |
| 3-5 | PBD4 | 140 | 0.356 |
| 3-6 | PBD4 | 150 | 0.788 |
| 3-7 | PBD4 | 160 | 1.418 |
| 3-8 | PBD4 | 170 | 1.749 |

These data also show that polymeric blocked developers are useful in photothermographic coatings, forming significant amounts of dye density with a magenta coupler under dry processing conditions.

The invention has been described in detail with particular reference to preferred embodiments, but it will be understood that variations and modifications can be effected within the spirit and scope of the invention.

What is claimed is:

1. An imaging element comprising an imaging layer having associated therewith a compound having the following structure:

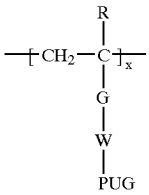

wherein x, the average degree of polymerization, is at least 10, R is hydrogen or methyl and G is selected from the following group:

(C)

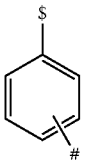

(D)

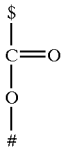

(E)

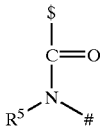

wherein $ denotes the bond to the polymeric backbone and # denotes the bond to W; and wherein $R^5$ is hydrogen or substituted or unsubstituted alkyl or aryl;

W is absent or a bivalent spacer group selected from a substituted or unsubstituted (referring to the following W groups) alkylene, arylene, alkylarylene or alkyleneoxy and wherein W in combination with X, Y, or Z below may form a ring;

PUG is a residue of removing a hydrogen from one of X, Y, or Z in the following compound:

(A)

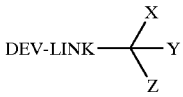

wherein DEV is a releasable developing agent;

LINK is a linking group; and

X, Y, and Z represent substituents selected independently from the groups hydrogen, alkyl group, cyclopropyl, aryl, arylalkyl, and heterocyclic groups, wherein at least one of X, Y, and Z is an aryl group, and wherein any two or three of X, Y and Z can form a aliphatic, unsaturated or aromatic ring system, and one of X, Y, Z, which may or may not be an aryl group, is attached in the direction of the backbone.

2. An imaging element according to claim 1, wherein the developing agent is an aminophenol, phenylenediamine, hydroquinone, pyrazolidinone, or hydrazine.

3. An imaging element according to claim 2, wherein the developing agent is a phenylenediamine.

4. An imaging element according to claim 1, where LINK is of Structure III:

III

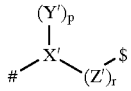

wherein

X' represents carbon or sulfur;

Y' represents oxygen, sulfur or N—R, where R is substituted or unsubstituted alkyl or substituted or unsubstituted aryl;

p is 1 or 2;

Z' represents carbon, oxygen or sulfur;

r is 0 or 1;

with the proviso that when X' is carbon, both p and r are 1, when X' is sulfur, Y' is oxygen, p is 2 and r is 0;

# denotes the bond to DEV;

$ denotes the bond to carbon substituted with the X, Y, and Z substituents.

5. An imaging element according to claim 4, where LINK is one of the following:

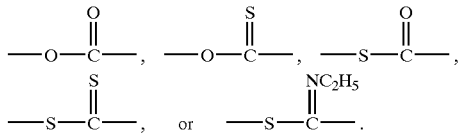

6. An imaging element according to claim 5, wherein LINK is

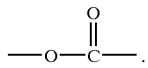

7. An imaging element according to claim 1, wherein said compound is the residue formed by removing a hydrogen from X, Y or Z in a blocked developer having the following Structure:

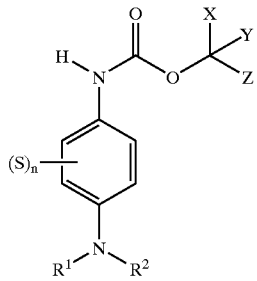

wherein $R^1$ and $R^2$ are independently hydrogen or an alkyl group, which may be further substituted, or $R^1$ and $R^2$ may join to form a heterocyclic ring;

S represents s independently selected substituents selected from the group consisting of halogen, hydroxy, amino, alkoxy, carbonamido, sulfonamido, alkylsulfonamido and alkyl, any of which may be further substituted; or said selected substituents when ortho to $NR^1R^2$ can form a heterocyclic ring with $R^1$ or $R^2$; and n is 0 to 4.

8. An imaging element according to claim 1 in which the element is a photothermographic element.

9. An imaging element according to claim 8, wherein the photothermographic element contains an imaging layer comprising a light-sensitive silver-halide emulsion and, a non-light-sensitive silver-salt oxidizing agent.

10. A method of image formation comprising the step of developing an imagewise exposed imaging element according to claim 1.

11. A method according to claim 10, wherein said developing comprises treating said imagewise exposed element at a temperature between about 90° C. and about 180° C. for a time ranging from about 0.5 to about 60 seconds.

12. A method according to claim 10, wherein said developing comprises treating said imagewise exposed element to a volume of processing solution is between about 0.1 and about 10 times the volume of solution required to fully swell the imaging element.

13. A method according to claim 10, wherein the developing is accompanied by the application of a laminate sheet containing additional processing chemicals.

14. A method according to claim 10, wherein the developing is conducted at a processing temperature between about 20° C. and about 100° C.

15. A method according to claim 10, wherein the applied processing solution is a base, acid, or pure water.

16. A method of claim 10, wherein said developing comprises treating said imagewise element with a photographic processing solution.

17. A method of image formation comprising the step of scanning and imagewise exposed and developed imaging element according to claim 1 to form a first electronic image representation of said imagewise exposure.

18. A method according to claim 17, wherein said first electronic image representation is a digital image.

19. A method of image formation comprising the step of digitizing a first electronic image representation formed from an imagewise exposed, developed, and scanned imaging element formulated according to claim 1 to form a digital image.

20. The method of claim 19 comprising the step of modifying the first electronic image representation formed from and imagewise exposed, developed, and scanned imaging element to form a second electronic image representation.

21. A method of image formation comprising storing, transmitting, printing, or displaying and electronic image representation of an image derived from an imagewise exposed, developed, scanned imaging element formulated according to claim 1.

22. A method according to claim 21, wherein said electronic image representation is a digital image.

23. A method according to claim 21, wherein the image is printed using an electrophotographic, inkjet, or thermal dye sublimation printer or by printing to sensitized photographic paper.

* * * * *